US011412592B2

(12) United States Patent
Archer et al.

(10) Patent No.: US 11,412,592 B2
(45) Date of Patent: Aug. 9, 2022

(54) USING A LINEAR PASS ELEMENT IN QUASI SATURATION MODE TO CONTROL RIPPLE

(71) Applicant: ERP POWER, LLC, Moorpark, CA (US)

(72) Inventors: Michael Archer, Moorpark, CA (US); Louis Chen, Simi Valley, CA (US); James H. Mohan, Valencia, CA (US)

(73) Assignee: ERP POWER, LLC, Moorpark, CA (US)

( * ) Notice: Subject to any disclaimer, the term of this patent is extended or adjusted under 35 U.S.C. 154(b) by 0 days.

(21) Appl. No.: 17/307,536

(22) Filed: May 4, 2021

(65) Prior Publication Data

US 2022/0039233 A1 Feb. 3, 2022

Related U.S. Application Data

(60) Provisional application No. 63/057,589, filed on Jul. 28, 2020.

(51) Int. Cl.
*H05B 45/36* (2020.01)
*H05B 45/3725* (2020.01)
(Continued)

(52) U.S. Cl.
CPC ..... *H05B 45/36* (2020.01); *H05B 45/10* (2020.01); *H05B 45/345* (2020.01); *H05B 45/3725* (2020.01)

(58) Field of Classification Search
CPC ..... H05B 41/2828; H05B 45/375; H05B 45/385; H05B 45/3725; H05B 45/20; H05B 45/56; H05B 45/10; H05B 45/24; H05B 47/175; H05B 41/2827; H05B 45/18; H05B 45/36; H05B 45/38; H05B 47/11; H05B 45/32; H05B 45/325; H05B 45/3578; H05B 45/382; H05B 41/2824; H05B 41/3927; H05B 45/22; H05B 45/3575; H05B 45/39; H05B 45/395; H05B 45/46; H05B 45/60; H05B 47/10; H05B 47/105; H05B 47/16; H05B 47/19; H05B 47/24; H05B 47/25; H05B 41/2855; H05B 45/12; H05B 45/14; H05B 45/28; H05B 45/31; H05B 45/315; H05B 45/327; H05B 45/34; H05B 45/355; H05B 45/37; H05B 45/397; H05B 47/115; H02M 3/156; H02M 3/157; H02M 3/1588;
(Continued)

(56) References Cited

U.S. PATENT DOCUMENTS

2011/0115399 A1* 5/2011 Sadwick ..... H05B 45/385 315/287
2012/0081934 A1* 4/2012 Garrity ..... H02M 7/46 363/37

(Continued)

*Primary Examiner* — Monica C King
(74) *Attorney, Agent, or Firm* — Lewis Roca Rothgerber Christie LLP

(57) ABSTRACT

A power supply system includes a rectifier configured to rectify an input signal to generate a rectified signal having a single polarity, a converter configured to generate a drive signal for powering a light source, and a ripple control system including a voltage-controlled resistor (VCR) coupled to a secondary-side of the converter and configured to dynamically adjust a resistance of the VCR to compensate for ripples in the drive signal.

20 Claims, 4 Drawing Sheets

(51) Int. Cl.
*H05B 45/10* (2020.01)
*H05B 45/345* (2020.01)

(58) Field of Classification Search
CPC .. H02M 1/0012; H02M 1/0845; H02M 1/007; H02M 1/008; H02M 3/33507; H02M 3/33523; H02M 1/0009; H02M 1/08; H02M 7/4807; H02M 1/0025; H02M 1/0032; H02M 1/0058; H02M 1/0006; H02M 3/158; H02M 3/285; H02M 3/335; H02M 5/458; H02M 7/46; H02M 3/1584; H02M 1/0035; H02M 1/0074; H02M 1/32; H02M 1/4208; H02M 1/4225; H02M 3/33515; H02M 3/33576; H02M 1/0003; H02M 1/0054; H02M 1/44; H02M 3/1582; H02M 3/28; H02M 3/33553; H02M 3/33592; H02M 1/0077; H02M 1/36; H02M 3/3376; H02M 5/225; H02M 5/293
See application file for complete search history.

(56) References Cited

U.S. PATENT DOCUMENTS

| | | | | |
|---|---|---|---|---|
| 2014/0265935 | A1* | 9/2014 | Sadwick | H05B 45/56 315/307 |
| 2015/0365003 | A1* | 12/2015 | Sadwick | H02M 3/28 363/21.01 |
| 2019/0393788 | A1* | 12/2019 | Papica | H02M 1/32 |
| 2020/0328590 | A1* | 10/2020 | Yu | H02M 3/33569 |

* cited by examiner

USING A LINEAR PASS ELEMENT IN QUASI SATURATION MODE TO CONTROL RIPPLE

CROSS-REFERENCE TO RELATED APPLICATIONS

This application claims priority to and the benefit of U.S. Provisional Application No. 63/057,589, filed on Jul. 28, 2020, the entire contents of which is incorporated herein by reference.

The present application is also related to U.S. Patent Application entitled "DIGITAL CONTROL OF QUASI SATURATED FETS FOR RIPPLE CONTROL", filed on even date herewith, which claims priority to and the benefit of U.S. Provisional Application No. 63/060,980, filed Aug. 4, 2020, the entire contents of which are incorporated herein by reference.

FIELD

Aspects of the present invention are related to light emitting diode (LED) drivers.

BACKGROUND

A light emitting diode (LED) is an electronic device that converts electrical energy (commonly in the form of electrical current) into light. The light intensity of an LED is primarily based on the magnitude of the driving current. Given that an LED luminosity is very sensitive to drive current changes, in order to obtain a stable luminous output without flicker, it is desirable to drive LEDs by a constant-current source.

Generally, lighting sources are powered by an input AC voltage of 110 or 220 VAC at 50 or 60 Hz line frequency. The input AC voltage is rectified via a rectifier and converted to a desired output voltage level that will be utilized by the LED. As any input power ripple may induce an output voltage ripple and output current ripple, a feedback loop that measures the output of the converter may be used to implement ripple control.

The above information disclosed in this Background section is only for enhancement of understanding of the invention, and therefore it may contain information that does not form the prior art that is already known to a person of ordinary skill in the art.

SUMMARY

Aspects of embodiments of the present invention are directed to a power supply system utilizing a secondary-side ripple controller that is isolated from the primary side of the power supply system. As all measurements and correction are performed on the secondary side of the power supply system's converter, ripple correction can be performed quickly and efficiently. Additionally, the need for optocouplers used to transmit feedback control data from the secondary side to the primary side is reduced as the need to communicate between isolated circuits is reduced (or minimized), which reduces overall system complexity and cost.

Aspects of embodiments of the present invention are directed to a power supply system utilizing a secondary-side voltage threshold controller that operates in conjunction with a ripple controller. In some embodiments, power factor (PF) and total harmonic distortion (THD) issues that generally result from feedback control delays from secondary to primary sides, can be avoided by the voltage threshold controller. Further, the voltage threshold controller lowers the voltage headroom at the secondary side to reduce or minimize power loses due to the ripple controller.

According to some embodiments, there is provided a power supply system including: a rectifier configured to rectify an input signal to generate a rectified signal having a single polarity; a converter configured to generate a drive signal for powering a light source; and a ripple control system including a voltage-controlled resistor (VCR) coupled to a secondary-side of the converter and configured to dynamically adjust a resistance of the VCR to compensate for ripples in the drive signal.

In some embodiments, the ripple control system further includes: a sense resistor configured to sense the drive signal; a reference generator configured to generate a reference signal; and an operational amplifier configured to receive the reference signal and the sensed drive signal, and to generate a gate control signal based on a difference between the reference signal and the sensed drive signal, wherein the VCR is electrically coupled to the sense resistor and the operational amplifier, the resistance of the VCR being determined by the gate control signal.

In some embodiments, the sense resistor has a resistance of 0.1Ω to 2Ω, and the resistance of the VCR varies from 0.1Ω to 10 kΩ depending on the gate control signal.

In some embodiments, the sense resistor is electrically coupled between an output terminal of the converter and a terminal of the VCR, and the VCR is electrically coupled between the sense resistor and an input terminal of a light source.

In some embodiments, the operational amplifier is configured to dynamically adjust the resistance of the VCR in response to changes in the drive signal.

In some embodiments, wherein the reference generator is configured to generate the reference signal based on a dimmer setting from a dimming controller.

In some embodiments, the VCR includes: a metal-oxide-semiconductor field-effect transistor (MOSFET) having a gate electrically coupled to an output of the operational amplifier.

In some embodiments, the operational amplifier is configured to maintain the MOSFET in an ohmic region of operation.

In some embodiments, the converter is a DC-DC converter, the rectifier is a bridge rectifier, and the input signal is an alternating-current (AC) signal.

In some embodiments, the reference generator includes: a pulse-width modulation (PWM) generator configured to generate a PWM signal corresponding to the reference signal; and a low-pass filter configured to filter the PWM signal to generate the reference signal.

In some embodiments, the reference generator includes: a digital circuit configured to generate a digital signal corresponding to the reference signal; and a digital-to-analog converter (DAC) configured to convert the digital signal to the reference signal.

In some embodiments, the ripple control system is electrically isolated from a primary side of the converter.

According to some embodiments, there is provided a power supply system including: a converter configured to generate a drive signal based on a rectified input signal for powering a light source; a ripple control system including a voltage-controlled resistor (VCR) coupled to a secondary-side of the converter and configured to dynamically adjust a resistance of the VCR to compensate for ripples in the drive signal; and a voltage threshold controller configured to sense a voltage drop across the VCR and to generate a feedback signal to control the drive signal of the converter based on the voltage drop.

In some embodiments, the power supply system further includes a rectifier configured to rectify an input signal to generate the rectified input signal having a single polarity.

In some embodiments, the converter is configured to reduce the voltage drop across the VCR based on the feedback signal.

In some embodiments, the voltage threshold controller is configured to provide the feedback signal to the converter, and the converter is configured to regulate a DC-level voltage of the drive signal based on the feedback signal.

In some embodiments, the power supply system further includes: a primary controller coupled to a primary side of the converter, wherein the voltage threshold controller is configured to provide the feedback signal to the primary controller, and wherein the primary controller is configured to regulate a DC-level voltage of the drive signal based on the feedback signal.

In some embodiments, the converter has a primary side and a secondary side electrically isolated from, and inductively coupled to, the primary side.

In some embodiments, the voltage threshold controller is configured to communicate the feedback signal to a primary side of the converter via an optocoupler.

In some embodiments, the ripple control system further includes: a sense resistor configured to sense the drive signal; a reference generator configured to generate a reference signal; and an operational amplifier configured to receive the reference signal and the sensed drive signal, and to generate a gate control signal based on a difference between the reference signal and the sensed drive signal, wherein the VCR is electrically coupled to the sense resistor and the operational amplifier, the resistance of the VCR being determined by the gate control signal.

BRIEF DESCRIPTION OF THE DRAWINGS

The accompanying drawings, together with the specification, illustrate example embodiments of the present invention, and, together with the description, serve to explain the principles of the present invention.

DETAILED DESCRIPTION

The detailed description set forth below is intended as a description of example embodiments of a power supply system with a ripple correction circuit, provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
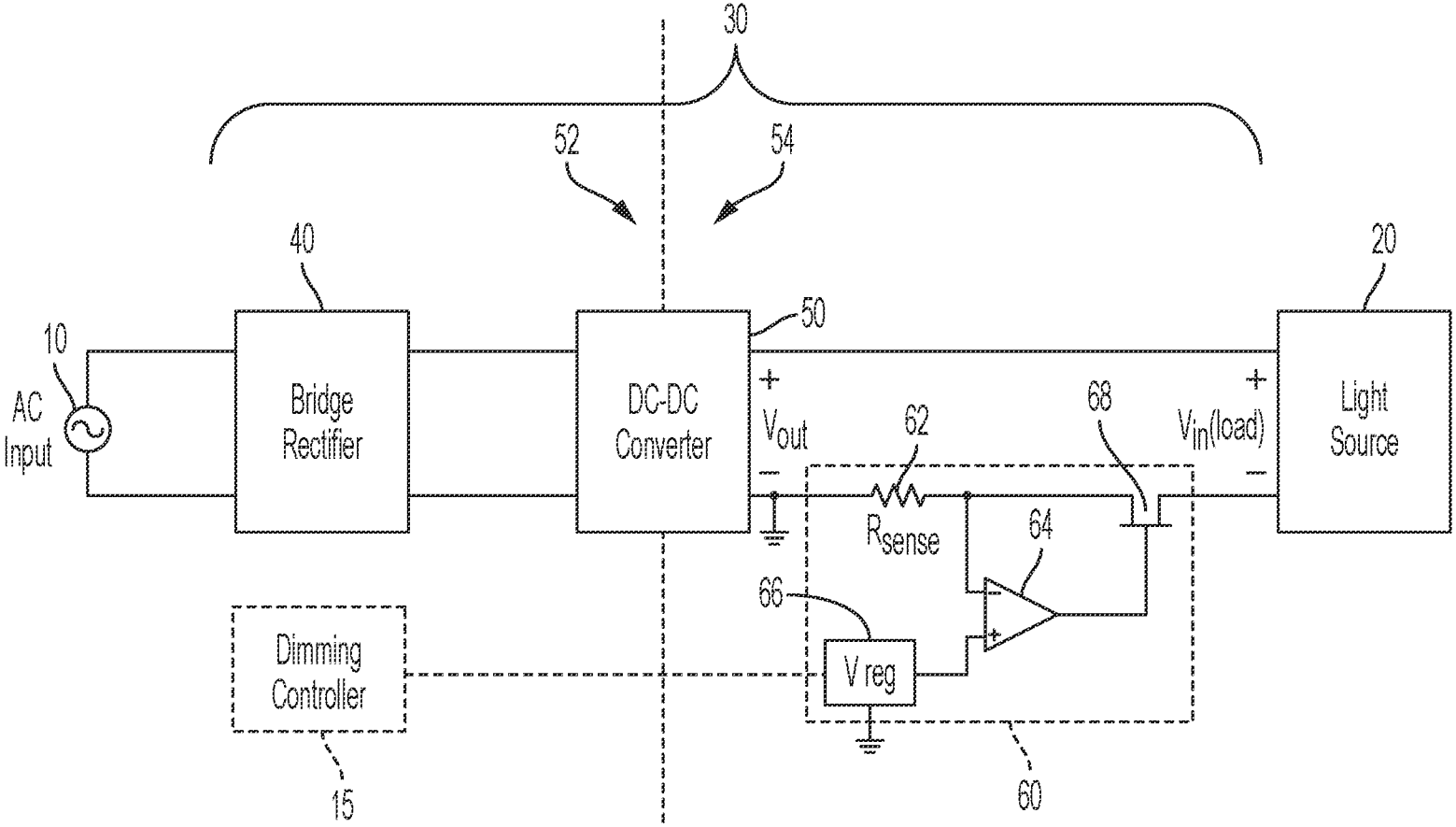
FIG. 1 illustrates a lighting system including a power supply system having a ripple correction system, according to some example embodiments of the present disclosure.

FIG. 1 illustrates a lighting system including a power supply system having a ripple correction system, according to some example embodiments of the present disclosure.

According to some embodiments, the lighting system 1 includes an input source 10, a light source 20, and a power supply system 30 (e.g., a switched-mode power supply) for powering and controlling the brightness of the light source 20 based on the signal from the input source 10.

The input source 10 may include an alternating current (AC) power source that may operate at a voltage of 100 Vac, a 120 Vac, a 240 Vac, or 277 Vac, for example. The input source 10 may also include a dimmer electrically powered by said AC power sources. The dimmer may modify (e.g., cut/chop a portion of) the input AC signal according to a dimmer level before sending it to the power supply system 30, and thus variably reduces the electrical power delivered to the power supply system 30 and the light source 20. In some examples, the dimmer may be a TRIAC or ELV dimmer, and may chop the front end or leading edge of the AC input signal. According to some examples, the dimmer interface may be a rocker interface, a tap interface, a slide interface, a rotary interface, or the like. A user may adjust the dimmer level by, for example, adjusting a position of a dimmer lever or a rotation of a rotary dimmer knob, or the like. The light source 20 may include one or more light-emitting-diodes (LEDs) or an arc or gas discharge lamp with electronic ballasts, such as high intensity discharge (HID) or fluorescent lights.

In some embodiments, the power supply system 30 includes a rectifier 40, a converter 50, and a ripple control system (e.g., a secondary-side ripple control system) 60.

The rectifier 40 may provide a same polarity of output for either polarity of the AC signal from the input source 10. In some examples, the rectifier 40 may be a full-wave circuit using a center-tapped transformer, a full-wave bridge circuit with four diodes, a half-wave bridge circuit, or a multi-phase rectifier.

The converter (e.g., the DC-DC converter) 50 converts the rectified AC signal generated by the rectifier 40 into a drive signal for powering and controlling the brightness of the light source 20. The drive signal may depend on the type of the one or more LEDs of the light source 20. For example, when the one or more LEDs of the light source 20 are constant current LEDs the drive signal may be a variable voltage signal, and when the light source 20 requires constant voltage, the drive signal may be a variable current signal. In some embodiments, the converter 50 includes a boost converter for maintaining (or attempting to maintain) a constant DC bus voltage on its output while drawing a current that is in phase with and at the same frequency as the line voltage (by virtue of the PFC circuit). Another switched-mode converter (e.g., a transformer) inside the converter 50 produces the desired output voltage from the DC bus. In some examples, the converter 50 may include a PFC circuit for improving (e.g., increasing) the power factor of the load on the input source 10 and reducing the total harmonic distortions (THD) of the power supply system 30. The converter has a primary side 52 and a secondary side 54 that is electrically isolated from, and inductively coupled to, the primary side 52.

In the related art, ripple control at the output of the converter 50 may be achieved by making signal measurements (e.g., voltage and/or current measurements) of the converter output and feeding the measured signal (e.g., measured voltage and/or current) back to the input of the converter 50. When an outlier ripple is measured, a voltage control loop may issue a change in switching frequency for the primary side DC-DC converter, thus adjusting the output of the secondary side voltage into the light source. However, the feedback delay may make it difficult for the converter 50 to implement corrections in real time with output ripples. Further, this delay may result in positive feedback and loop instability, which may produce undesirable voltages at the output of the converter 50.

According to some embodiments, the ripple control system 60 (also referred to a secondary-side ripple control circuit/stage) is electrically coupled to the secondary side 54 of the converter 50 and electrically isolated from the primary side 52. The ripple control system 60 includes sense resistor 62, an operational amplifier (also referred to as an error amplifier) 64, a reference generator (e.g., a reference voltage or current generator) 66, and a voltage-controlled resistor (VCR, e.g., a linear pass element) 68. The sense resistor 62 may be positioned between the output of the converter 50 and the light source 20 and is connected electrically in series with the light source 20. The ripple control system 60 measures the output signal (e.g., output current/voltage $I_{sense}/V_{sense}$) of the converter 50 via the sense resistor 62, and provides the measured signal (current/voltage) to the first input terminal (e.g., the negative terminal) of the error amplifier 64 to compare with a reference signal (e.g., a reference current/voltage) supplied by the reference generator 66. The error signal (also referred to as a gate control signal) $V_{err}$ that is then generated by the error amplifier 64 is used to control the voltage drop across the VCR 68.

According to some embodiments, the reference signal generated by the reference generator 66 is used to determine (e.g., set) the DC-signal level that the input voltage $V_{in}$ of the light source 20 is to be regulated to. In some examples, the reference generator 66 may provide a fixed/constant voltage to the error amplifier 64. However, embodiments of the present disclosure are not limited thereto. For example, in embodiments in which the input source 10 includes a dimmer, the reference generator 66 adjusts the reference signal (e.g., the reference voltage/current) according to the intensity setting at the dimmer. In some embodiments, the lighting system 1 includes a dimmer controller 12 (which may be incorporated into the 30) that controls/determines the reference signal (e.g., the reference signal level) based on a dimmer setting. In some examples, the reference generator 66 provides a reference signal to a second input terminal (e.g., the positive terminal) of the error amplifier 64.

According to some embodiments, the VCR 68 is electrically connected in series with the sense resistor 62 and the light source 20. In some embodiments, the VCR 68 is a field effect transistor (FET), such as a junction FET (JFET) or a metal-oxide-semiconductor field-effect transistor (MOSFET), that operates in the quasi-saturation region (e.g., linear/ohmic region) and functions as a variable resistor, whose resistance is controlled by the gate voltage. However, embodiments of the present disclosure are not limited thereto, and any suitable 3-terminal or 4-terminal active device may be utilized as the VCR.

According to some embodiments, the error signal $V_{err}$ from the error amplifier 64 controls the resistance of the VCR 68. In some examples, the resistance of the VCR 68 (e.g., the drain-source resistance $R_{ds}$ of the MOSFET) may vary from about 0.1Ω to about 10 kΩ depending on the error signal.

The DC voltage that is applied to the load is the output voltage $V_{out}$ of the DC-DC converter minus the voltage drop across the VCR 68. In some embodiments, when the converter output voltage $V_{out}$ rises above the desired value, which corresponds to the regulated voltage of the reference generator 66, the ripple control system 60 increases the resistance of the VCR 68 until the voltage drop across the VCR 68 counteracts (e.g., rises sufficiently to cancel) the rise in the converter output voltage $V_{out}$. Conversely, when the converter output voltage $V_{out}$ drops below the desired value, the ripple control system 60 decreases the resistance of the VCR 68 until the voltage drop counteracts (e.g., decreases sufficiently to cancel) the rise in the converter output voltage $V_{out}$. Therefore, as the ripple control system 60 dynamically adjusts the resistance (and hence the voltage across) the VCR 68 in response to (and to compensate for) the instantaneous changes in the output voltage $V_{out}$ of the converter, the voltage signal at the input of the light source 20 may exhibit little to no ripple after the secondary side ripple control stage 60. In effect, the voltage drop across the VCR 68 (e.g., across the source and drain terminals of the MOSFET) act as a headroom for mitigating ripple in the secondary side voltage of the power supply system 30.

Accordingly, the ripple control system 60 observes and eliminates ripples quickly and efficiently as the reacting VCR 68 is not significantly delayed in how quickly it can respond to changes in the converter output signal. Further, the inclusion of the VCR 68 may eliminate the need for additional primary side components that would otherwise be needed to perform the same correction. The need for optocouplers used to transmit feedback control data from the secondary side to the primary side is reduced as the need to communicate between isolated circuits is reduced (or minimized). The decrease in components translates to a decrease in cost as the component count for performing correction is reduced.

While the topology of the related art may mitigate ripples so that they are within a tolerance of 20% after ripple correction, the power supply system 30 utilizing the VCR 68 on the secondary side, according to some embodiments, may mitigate ripples so that the resulting DC output into the light source 20 is within a tolerance of 1%.

Figure 2A:
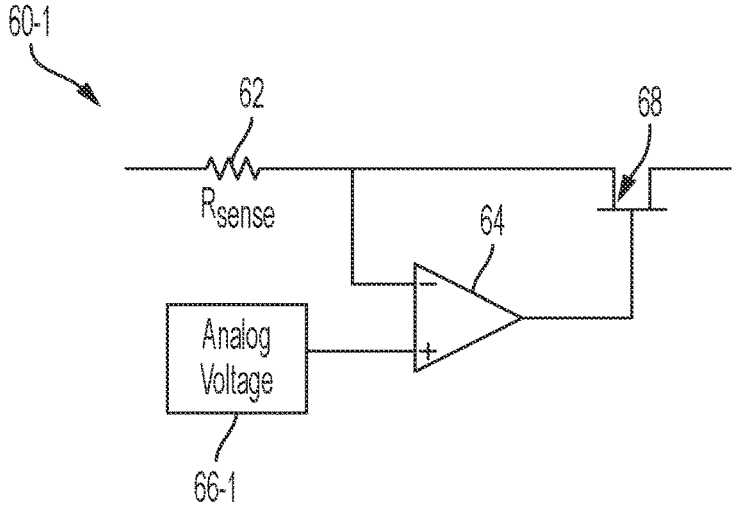
FIGS. 2A-2C illustrate schematic diagrams of various implementations of the ripple control system, according to some embodiments of the present disclosure.
Figure 2B:
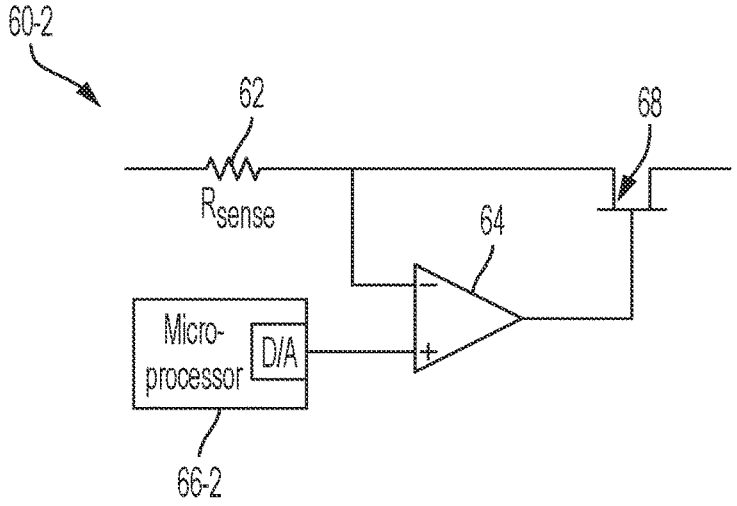

FIGS. 2A-2B illustrates schematic diagrams of various implementations of the ripple control system 60, according to some embodiments of the present disclosure.

According to some examples (see, e.g., FIG. 2A), the reference generator 66-1 is an analog circuit including a zener diode, a linear voltage regulator, and/or the like.

In some examples (see, e.g., FIG. 2B), the reference generator includes a digital circuit, such a microprocessor, for generating a digital signal corresponding to the desired regulation voltage/current of the power supply system 30, and includes a digital-to-analog (DAC) converter for translating (e.g., converting) the digital signal from the digital processor to an analog signal that may be utilized by the error amplifier 64.

Figure 2C:
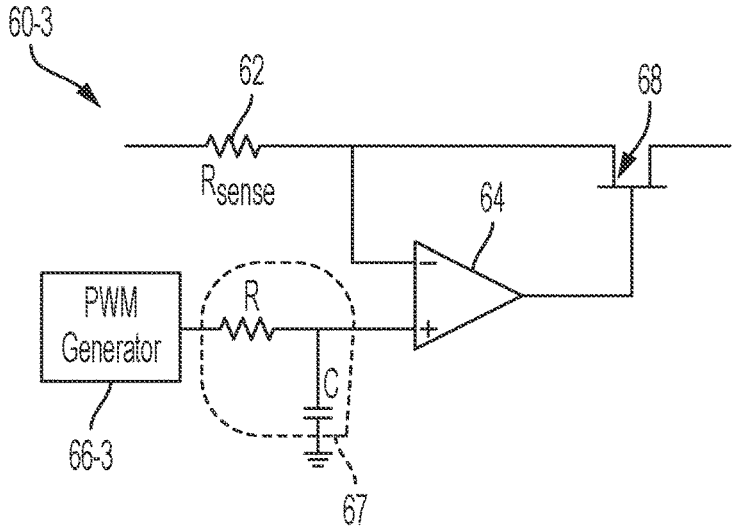

In some examples (see, e.g., FIG. 2C), the reference generator 66-3 includes a pulse-width modulator (PWM) that generates a pulse-width modulated signal corresponding to the desired regulation voltage/current of the power supply system 30 and includes a low pass filter 67 for converting the PWM signal to a DC signal for consumption by the error amplifier.

Throughout this disclosure, a reference to the ripple control system 60 may be a reference to any one of the ripple control systems 60-1, 60-2, and 60-3.

While the ripple control system 60 may substantially reduce or eliminate ripple at the input of the light source 20 by modifying the dynamic resistance $R_{dyn}$ of the VCR 68, this induced resistance $R_{dyn}$ may lead to additional power losses in the power supply system. The resistance $R_{dyn}$ dissipates energy at a rate of $$P=I^2*R_{dyn} \quad \text{(Eq. 1)}$$

where I is the drive current of the converter 50 and P is the power loss at the VCR 68. At a constant desired current, the power dissipated is dependent on the value of $R_{dyn}$. A larger voltage drop across the VCR 68 results in a larger induced resistance $R_{dyn}$. This translates to an increase in power dissipation by the VCR 68.

In examples in which the power supply system 30 is designed for light sources having a particular drive voltage, the converter 50 may be designed to provide a voltage that is slightly higher than the drive voltage (e.g., a voltage that is equal to the drive voltage plus a ripple control headroom). As such, the voltage drop across the VCR 68 may be managed to be low (e.g., about 0.1 V to about 2 V), which can limit (e.g., minimize) the power loss due to the VCR. For example, when the light source 20 has a 24 V input, the converter output $V_{out}$ may be about 24.5 V to about 25 V, and when the light source 20 has a 37 V input, the converter output $V_{out}$ may be about 37.5 V to about 38 V. In such examples, the voltage drop across the VCR 68 may be about 0.5 V to about 1 V.

However, when designing a converter that is compatible with a variety of light sources with a wide range of drive voltages, the converter may be designed at the highest voltage within the range, and thus, the power loss due to the resistance of the VCR may be more prominent when driving a light source with a low power drive voltage.

The power supply system, according to some embodiments, includes a voltage control loop for appropriately lowering the output voltage of the power supply system in such examples, which can reduce (e.g., minimize) the power loss of the VCR 68, even when the power supply system is designed to be compatible with a variety of light sources with a wide range of drive voltages.

Figure 3:
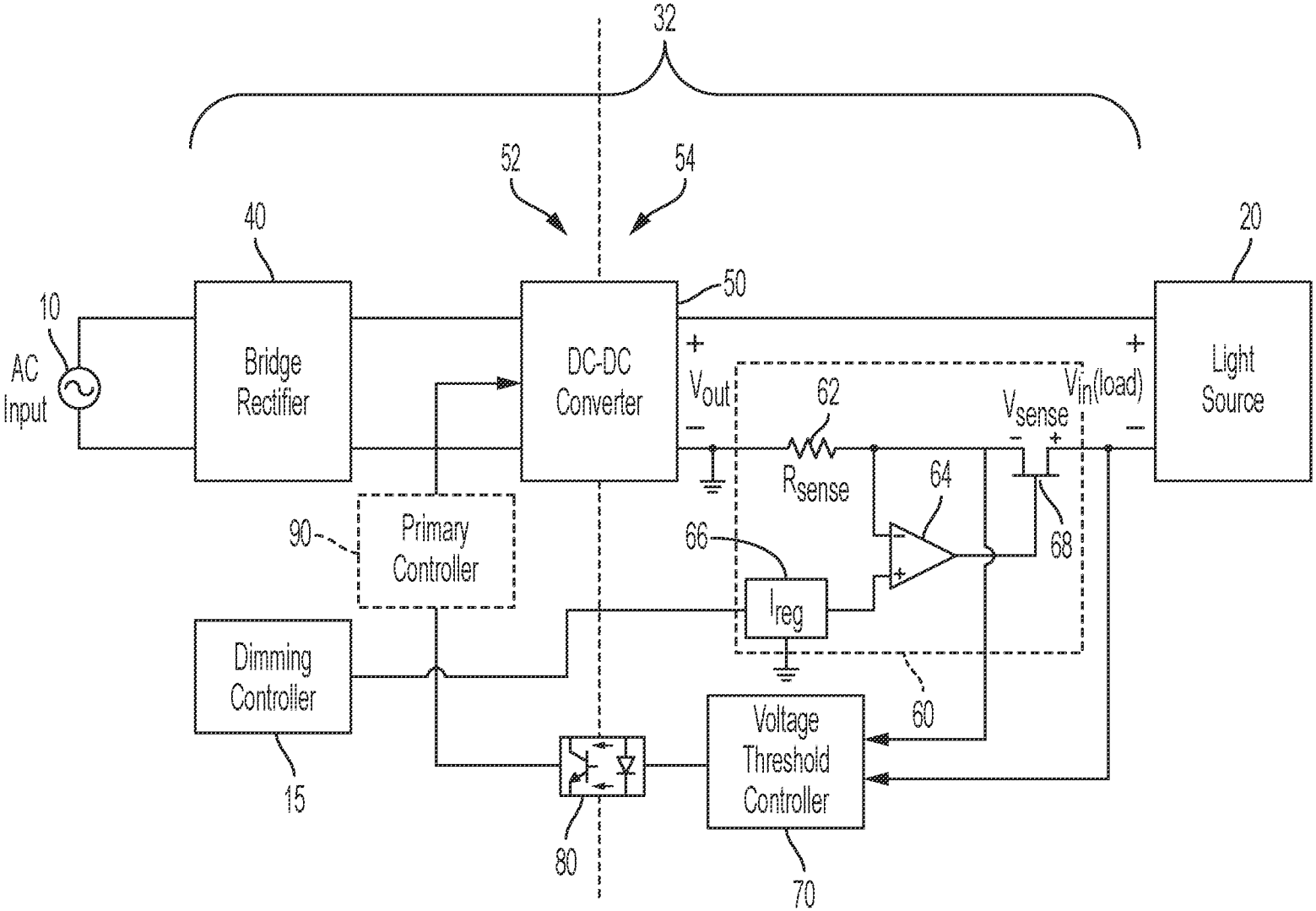
FIG. 3 is a block diagram illustrating a power supply system with ripple correction and feedback, according to some embodiments of the present disclosure.

FIG. 3 is a block diagram illustrating a power supply system 32 with ripple correction and feedback, according to some embodiments of the present disclosure. The bridge rectifier 40, the converter 50, and the ripple control system 60 of the power supply system 32 may be the same or substantially the same as those of the power supply system 30. As such, a description thereof may not be repeated here for sake of brevity.

According to some embodiments, the power supply system 32 includes a voltage threshold controller 70 for controlling the voltage level of the converter output $V_{out}$. In some embodiments, the voltage threshold controller 70 measures/senses the voltage $V_{VCR}$ across the VCR 68 and sends a feedback signal to the converter 50 to adjust (e.g., lower) the output voltage $V_{out}$ and hence the headroom between the converter output $V_{out}$ and the voltage received by the light source 20. In other words, the voltage threshold controller 70 adjusts the converter output to better match the desired drive voltage of the light source 20. Reducing the voltage drop across the VCR 68 results in lower power dissipation by the ripple control system 60. In some examples, the feedback voltage may control the voltage headroom (e.g., ripple headroom) by controlling/adjusting the switching frequency of the main switch of the converter 50.

In some examples, the feedback signal from the voltage threshold controller 70, which is on the secondary side 54 of the converter 50, is communicated through the primary-secondary barrier of the converter 50 via an optocoupler 80, which enables communication between the primary and secondary sides 52 and 54 of the converter 50 while maintaining the electrical isolation between the two sides. In some embodiments, the feedback signal is received by a primary controller (e.g., a primary-side controller) 90, which may perform power factor correction for the power supply system 32. In some embodiments (e.g., when the primary controller 90 is integrated into the converter 50), the feedback signal is provided directly to the input of the converter 50.

The voltage threshold controller 70 operates in conjunction with the ripple control system 60, which performs ripple correction. Accordingly, as described above, the power supply system 32 with secondary-side ripple control can lower overall system cost due to fewer optocouplers used in the design, and can improve accuracy and reduce (e.g., minimize) delay as the VCR 68 may react as fast as the changes in its gate signal are produced. As such, power factor (PF) and total harmonic distortion (THD) issues that generally result from feedback control delays from secondary to primary sides, can be avoided by the voltage threshold controller 70. Further, the secondary-side ripple control is isolated from the primary high-voltage side and inherently lowers the voltage headroom at the secondary side to reduce or minimize power loses across the VCR 68.

Figure 4:
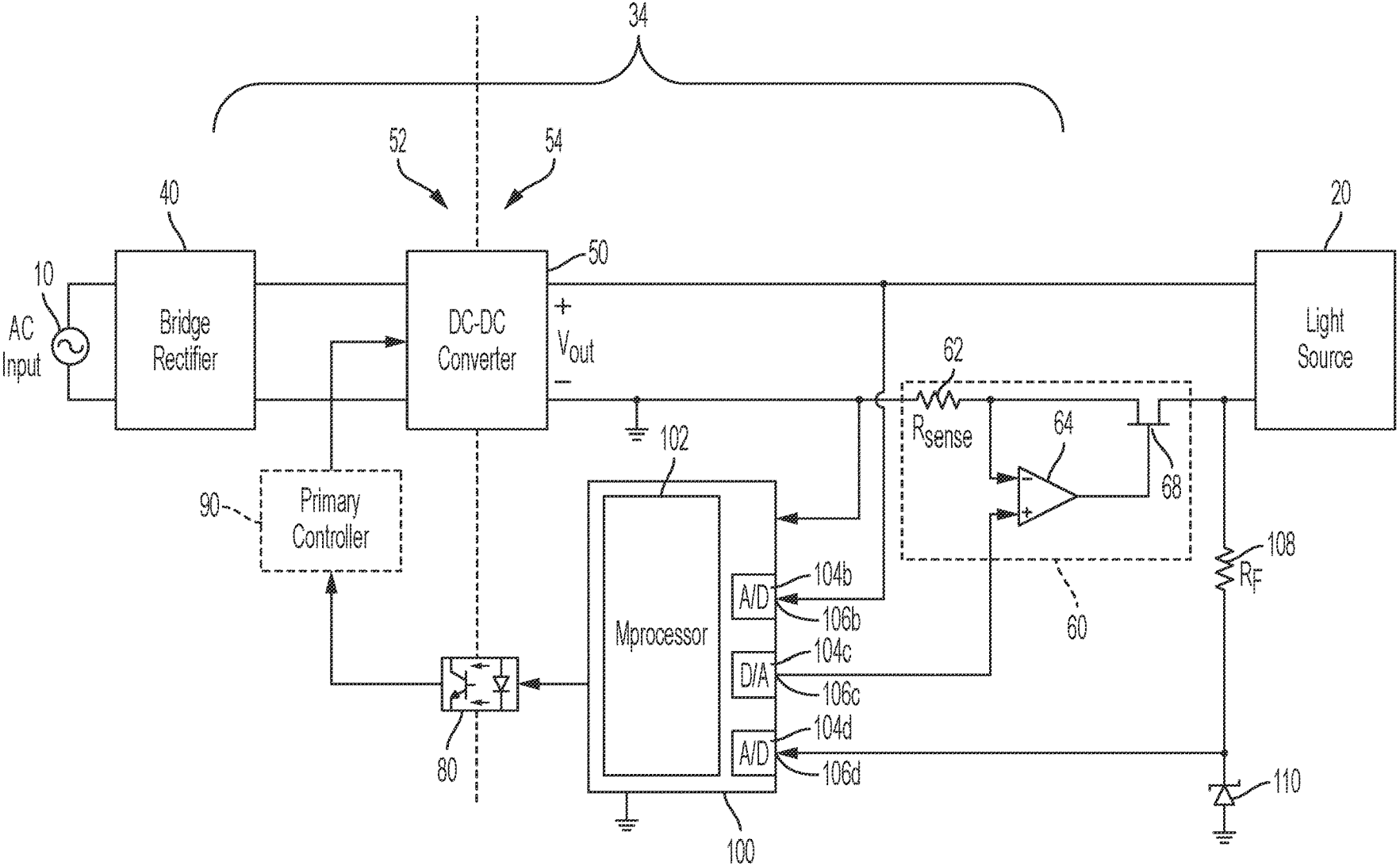
FIG. 4 is a block diagram illustrating a power supply system with ripple correction and feedback, according to some embodiments of the present disclosure.

FIG. 4 is a block diagram illustrating a power supply system 34 with ripple correction and feedback, according to some embodiments of the present disclosure.

According to some embodiments, the power supply system 34 includes a controller (e.g., a voltage threshold controller or secondary-side controller) 100 for controlling the voltage level of the converter output $V_{out}$. In some embodiments the controller 100 includes a programmable processor (e.g., a programmable microprocessor) 102 and a plurality of analog-to-digital (A/D) and digital-to-analog (D/A) converters **104*b*-104*d* that are connected to input and output terminals/ports 106*b*-106*d* of the controller 100**.

According to some embodiments, the controller 100 samples (e.g., measures) the output voltage $V_{out}$ of the converter 50 at the terminal **106*b* and converts the readings to digital binary form via the A/D converter 104*b* for further processing by the programmable processor 102**.

In some embodiments, the controller 100 supplies the reference signal (e.g., reference regulation voltage/current $V_{reg}/I_{reg}$) to the error amplifier 64 (e.g., to the positive input terminal of the error amplifier 64) to set the DC-signal level that the input voltage $V_{in}$ of the light source 20 is to be regulated to. In such embodiments, the reference generator 66 of the ripple control system 60 may be omitted as its function is performed by the controller 100. In some examples, the programmable processor 102 generates a digital binary reference value and the D/A converter **104*c* converts the binary reference value to the analog reference signal to be supplied to the error amplifier 64 via the third terminal 106*c*. In examples in which the light source 20 includes a dimmable LED, the programmable processor 102** may generate the digital binary reference value based on a dimmer setting (which may range from 0-100%).

According to some embodiments, the controller 100 senses (e.g., measures) the voltage $V_{VCR}$ across the VCR 68 via the fourth terminal **106*d* and the third A/D converter, which converts the sensed analog voltage at the fourth terminal 106*d* to a binary signal that may be processed by the programmable processor 102. In some embodiments, the fourth terminal 106***d* is coupled to the VCR 68 through a feedback resistor (RF) 108 and is coupled to a zener diode 110. In some examples, the anode of the zener diode 110 is connected ground and the cathode of the zener diode 110 is connected to the resistor 108 and the fourth terminal 106*d*. The resistor 108 may have a resistance of about 10 kΩ to about 500 kΩ (e.g., about 100 kΩ).

The zener diode 110 is configured to protect the controller 100 by preventing an unsuitably large voltage from being applied to the fourth terminal 106*d* when $V_{VCR}$ is larger than the rated voltage of the controller 100. In so doing, the zener diode 110 caps (e.g., limits) the voltage at the fourth terminal 106*d* to the zener voltage, which may be about 3.3 V to about 5 V. However, by limiting the sensed voltage at the fourth terminal 106*d*, the voltage drop across the VCR 68 may no longer be accurately observed above a certain voltage threshold (e.g., the zener voltage). Thus, the gain in the primary controller 90 may not be appropriate to bring down the voltage output of the converter 50 quick enough to ensure that power loses are minimized across the VCR 68.

According to some embodiments, when the sensed VCR voltage $V_{VCR}$ is less than a threshold, which may be a set percentage (e.g., 90% or 95%) of the zener voltage $V_z$ (e.g., when $V_{VCR}<0.9*V_z$), the programmable processor 102 determines that the sensed voltage $V_{VCR}$ is the true voltage drop across the VCR 68. As such, the processor 102 determines that the converter output voltage $V_{out}$ has overshot by the DC component of $V_{VCR}$ and signals the primary controller 90 or the converter 50 to adjust (e.g., reduce) the converter output voltage $V_{out}$ accordingly.

In some embodiments, when the sensed voltage $V_{VCR}$ is greater than or equal to a set percentage (e.g., 5% or 10%) of the zener voltage $V_z$ (e.g., when $V_{VCR}>=0.9*V_z$), actual the voltage across the VCR 68 may be masked by operation of the zener diode. As such, the processor 102 may correct the converter output voltage $V_{out}$ by an amount greater than the sensed voltage $V_{VCR}$. In some embodiments, the processor 102 determines that the converter output voltage $V_{out}$ has overshot by the sensed voltage $V_{VCR}$ plus the difference between the measured output voltage $V_{out}$ (as observed through the terminal 106*b*) and a set or predefined maximum output voltage $V_{max}$. In other words, the processor 102 correct the converter output by a calculated voltage drop (e.g., a correction value) equal to $V_{VCR}+|V_{out}-V_{max}|$. The maximum output voltage $V_{max}$, which may be programmed in the processor 102, represents a not-to-exceed voltage at the output of the converter 50. It is desirable for the output voltage of the converter 50 to not exceed the programed maximum voltage output. For example, for a power supply system that is designed to work with a wide variety of light sources, the maximum output voltage $V_{max}$ may be programmed to be about 42 V. The calculated voltage drop may provide a more accurate reading of the actual voltage drop across the VCR 68 when the sensed voltage $V_{VCR}$ is masked by the zener voltage $V_z$. This calculated voltage drop (i.e., the calculated correction value for $V_{VCR}$) may then be used to adjust the gain in the primary controller 90/converter 50. According to some examples, the overshoot of the converter output may occur on initial turn on or during dynamic load changes such as when dimming.

According to some embodiments, the processor 102 can learn the input voltage of the light source 20 and store the learned input voltage in a memory of the controller 100. The processor 102 then sets the maximum output voltage $V_{max}$ as the learned input voltage plus a margin (of, e.g., 0.2 V to about 1 V).

In some embodiments, the controller 100 communicates the calculated voltage drop/correction value, through a control signal, to the primary controller 90 or the converter 50 via the optocoupler 80. In some examples, the control signal output by the controller 100 may be a pulse width modulated (PWM) signal that may further be demodulated via an RC filter when desired. The correction value allows the converter 50 to adjust the output voltage $V_{out}$ to better match the input voltage of the light source 20. The DC voltage that is then applied to the light source 20 is the voltage output of the DC-DC converter minus the voltage drop across the VCR 68. According to some embodiments, this results in a voltage signal with little to no ripple after the secondary side ripple control stage. The added benefit of the voltage threshold control loop is that the smaller voltage drop across the FET results in lower power dissipation.

Accordingly, as described above, the power supply system with ripple control can lower overall system cost due to fewer optocouplers used in the design, and can improve accuracy and reduce (e.g., minimize) delay as the FET can react as fast as the changes in the gate signal are produced. Further, the functionality of physical circuitry can be provided digitally using the onboard programmable processor, thus, eliminating the need for additional physical components. Further, the processor can be programmed to automatically lower the voltage output of the DC-DC converter to reduce or minimize power dissipation in the voltage-controlled resistor.

It will be understood that, although the terms "first", "second", "third", etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of", when preceding a list of elements, modify the entire list of elements and do not modify the individual elements of the list. Further, the use of "may" when describing embodiments of the inventive concept refers to "one or more embodiments of the inventive concept". Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the terms "substantially", "about", and similar terms are used as terms of approximation and not as terms of degree, and are intended to account for the inherent variations in measured or calculated values that would be recognized by those of ordinary skill in the art.

As used herein, the terms "use", "using", and "used" may be considered synonymous with the terms "utilize", "utilizing", and "utilized", respectively.

The LED driver with an independent power feed for the RF communications module and/or any other relevant devices or components according to embodiments of the present invention described herein may be implemented by utilizing any suitable hardware, firmware (e.g., an application-specific integrated circuit), software, or a suitable combination of software, firmware, and hardware. For example, the various components of the independent multi-source display device may be formed on one integrated circuit (IC) chip or on separate IC chips. Further, the various components of the LED driver may be implemented on a flexible printed circuit film, a tape carrier package (TCP), a printed circuit board (PCB), or formed on the same substrate. Further, the various components of the LED driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer-readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While this invention has been described in detail with particular references to illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

What is claimed is:

1. A power supply system comprising:

a rectifier configured to rectify an input signal to generate a rectified signal having a single polarity;

a converter configured to generate a drive signal for powering a light source based on the rectified signal, the converter having a primary side and a secondary side electrically isolated from the primary side; and a ripple control system comprising a voltage-controlled resistor (VCR) coupled to the secondary side of the converter and electrically in series with the light source, the ripple control system being configured to dynamically adjust a resistance of the VCR based on the drive signal and a reference signal to compensate for ripples in the drive signal, the reference signal being based on a dimmer setting of the power supply system.

2. The power supply system of claim 1, wherein the ripple control system further comprises:

a sense resistor configured to sense the drive signal output by the converter;

a reference generator configured to generate the reference signal; and an operational amplifier configured to receive the reference signal and the sensed drive signal from the sense resistor, and to generate a gate control signal based on a difference between the reference signal and the sensed drive signal, wherein the VCR is electrically coupled to the sense resistor and the operational amplifier, the resistance of the VCR being determined by the gate control signal.

3. The power supply system of claim 2, wherein the sense resistor has a resistance of 0.1Ω to 2Ω, and wherein the resistance of the VCR varies from 0.1Ω to 10Ω depending on the gate control signal.

4. The power supply system of claim 2, wherein the sense resistor is electrically coupled between an output terminal of the converter and a terminal of the VCR, and wherein the VCR is electrically coupled between the sense resistor and an input terminal of the light source.

5. The power supply system of claim 2, wherein the operational amplifier is configured to dynamically adjust the resistance of the VCR in response to changes in the drive signal.

6. The power supply system of claim 2, wherein the reference generator is configured to generate the reference signal based on the dimmer setting from a dimming controller.

7. The power supply system of claim 2, wherein the VCR comprises:

a metal-oxide-semiconductor field-effect transistor (MOSFET) having a gate electrically coupled to an output of the operational amplifier.

8. The power supply system of claim 7, wherein the operational amplifier is configured to maintain the MOSFET in an ohmic region of operation.

9. The power supply system of claim 2, wherein the converter is a DC-DC converter, the rectifier is a bridge rectifier, and the input signal is an alternating-current (AC) signal.

10. The power supply system of claim 2, wherein the reference generator comprises:

a pulse-width modulation (PWM) generator configured to generate a PWM signal corresponding to the reference signal; and a low-pass filter configured to filter the PWM signal to generate the reference signal.

11. The power supply system of claim 2, wherein the reference generator comprises:

a digital circuit configured to generate a digital signal corresponding to the reference signal; and a digital-to-analog converter (DAC) configured to convert the digital signal to the reference signal.

12. The power supply system of claim 1, wherein the ripple control system is electrically isolated from the primary side of the converter.

13. A power supply system comprising:

a converter configured to generate a drive signal based on a rectified input signal for powering a light source, the converter having a primary side and a secondary side electrically isolated from the primary side;

a ripple control system comprising a voltage-controlled resistor (VCR) coupled to the secondary side of the converter and electrically in series with the light source, the ripple control system being configured to dynamically adjust a resistance of the VCR based on the drive signal and a reference signal to compensate for ripples in the drive signal, the reference signal being based on a dimmer setting of the power supply system; and a voltage threshold controller coupled to the secondary side of the converter and configured to sense a voltage drop across the VCR and to generate a feedback signal to control the drive signal of the converter based on the voltage drop.

14. The power supply system of claim 13, further comprising:

a rectifier configured to rectify an input signal to generate the rectified input signal having a single polarity.

15. The power supply system of claim 13, wherein the converter is configured to reduce the voltage drop across the VCR based on the feedback signal.

16. The power supply system of claim 13, wherein the voltage threshold controller is configured to provide the feedback signal to the converter, and wherein the converter is configured to regulate a DC-level voltage of the drive signal based on the feedback signal.

17. The power supply system of claim 13, further comprising:

a primary controller coupled to the primary side of the converter, wherein the voltage threshold controller is configured to provide the feedback signal to the primary controller, and wherein the primary controller is configured to regulate a DC-level voltage of the drive signal based on the feedback signal.

18. The power supply system of claim 13, wherein the converter has the primary side and the secondary side electrically isolated from, and inductively coupled to, the primary side.

19. The power supply system of claim 13, wherein the voltage threshold controller is configured to communicate the feedback signal to the primary side of the converter via an optocoupler.

20. The power supply system of claim 13, wherein the ripple control system further comprises:

a sense resistor configured to sense the drive signal output by the converter;

a reference generator configured to generate the reference signal; and an operational amplifier configured to receive the reference signal and the sensed drive signal from the sense resistor, and to generate a gate control signal based on a difference between the reference signal and the sensed drive signal, wherein the VCR is electrically coupled to the sense resistor and the operational amplifier, the resistance of the VCR being determined by the gate control signal.

* * * * *